US009398821B1

(12) United States Patent
Long

(10) Patent No.: US 9,398,821 B1
(45) Date of Patent: Jul. 26, 2016

(54) MAGNETIC SERVING SYSTEM, METHOD, AND DEVICE

(71) Applicant: Jordan Long, Newton, MA (US)

(72) Inventor: Jordan Long, Newton, MA (US)

( * ) Notice: Subject to any disclaimer, the term of this patent is extended or adjusted under 35 U.S.C. 154(b) by 0 days.

(21) Appl. No.: 14/567,428

(22) Filed: Dec. 11, 2014

Related U.S. Application Data

(60) Provisional application No. 61/914,544, filed on Dec. 11, 2013.

(51) Int. Cl.
*A47G 19/12* (2006.01)

(52) U.S. Cl.
CPC ..... *A47G 19/12* (2013.01); *B65D 2313/04* (2013.01)

(58) Field of Classification Search
CPC ..... B65D 2313/04
USPC ..... 206/818; 222/566; 141/DIG. 1
See application file for complete search history.

(56) References Cited

U.S. PATENT DOCUMENTS

| | | | | |
|---|---|---|---|---|
| 3,426,476 | A * | 2/1969 | Ayala | A63H 3/48 446/134 |
| 2011/0062160 | A1* | 3/2011 | Vasic | A47G 19/2205 220/483 |
| 2013/0213960 | A1* | 8/2013 | Cook | A47G 19/2205 220/23.87 |

* cited by examiner

*Primary Examiner* — Jeffrey Allen
*Assistant Examiner* — Jennifer Castriotta
(74) *Attorney, Agent, or Firm* — MacCord Mason PLLC; Richard J. Long

(57) ABSTRACT

Liquid serving and receiving containers are shown and described. In one embodiment, the assembly comprises a serving container having a magnetic field and a receiving container having an opposing magnetic field. In another embodiment, a method includes configuring serving and receiving containers to repel one another when aligned in an adjacent pouring position. The result is devices, assemblies, and methods for preventing cross-contamination of liquid food service containers and the like.

16 Claims, 2 Drawing Sheets

MAGNETIC SERVING SYSTEM, METHOD, AND DEVICE

This application claims the benefit of U.S. provisional application No. 61/914,544, filed Dec. 11, 2013, which is incorporated herein by reference in its entirety.

FIELD OF THE TECHNOLOGY

The present disclosure relates generally to food serving and best laboratory practice, and more particularly to improved hygienic food serving practices.

BACKGROUND

Spreading of germs in restaurants, and other places where food is served, is a continuing problem. One possible source of contamination and germ spreading is the touching of drink containers during pouring. For example, a food server may pour water from a pitcher into a glass and while pouring touch the pitcher to the glass. As the food server moves from one person's glass to the next, genus such as viruses and bacteria can be spread between customers. For example, a restaurant customer with an illness will drink a cup of water. The food server will refill the cup from a pitcher and touch the pitcher to the glass. The food server may then pour water into the next person's glass, also touching the pitcher to the glass and, thereby, spread the germ and, therefore, the illness, to the next person. Although it is well known to be poor serving technique to touch a serving pitcher to a glass or cup, it continues to be a widespread practice.

Therefore, Applicant desires devices, systems, and methods for minimizing and/or eliminating non-hygienic food serving practice without the drawbacks presented by the traditional systems and methods.

SUMMARY

In accordance with the present disclosure, liquid food service containers and methods are provided for various uses. This disclosure provides improved devices and arrangements that are convenient, efficient, and safe, particularly when used in the food service industry.

In one embodiment of the present disclosure, a device to prevent cross-contamination of liquid food service containers includes a liquid serving container having a magnetic portion. Typically, the magnetic portion provides a magnetic field in an area that is generally susceptible to touching a liquid receiving container. The liquid receiving container typically includes an opposing magnetic portion in the area that is generally susceptible to contact with the liquid serving container. The magnetic portion of the liquid receiving container is typically of a repelling pole to the magnetic portion of the liquid serving container. The magnetic field of the liquid serving container and the magnetic field of the liquid receiving container typically repel one another.

In one example, the liquid serving container's magnetic portion is an electromagnet. Similarly, the liquid receiving container's magnetic portion may be an electromagnet. In particular examples, the liquid serving is a pitcher. In addition, the pitcher may have a pouring spout that houses the magnetic portion. Another embodiment of the present disclosure includes an assembly for preventing cross-contamination of liquid food service containers. The assembly includes a liquid serving container and at least one liquid receiving container. Typically, the liquid serving container includes an outlet lip having a first magnetic field. The at least one liquid receiving container typically includes a receiving lip having a second magnetic field that is a repelling opposite pole of the first magnetic field. The serving container's outlet lip is typically susceptible to contact with the receiving container's receiving lip. The first magnetic field of the serving container and the second magnetic field of the receiving container typically repel one another to prevent cross-contamination.

In some examples, the first magnetic field and the second magnetic field each comprise a magnetic strength that is generally sufficient to prevent contact between the serving container and the receiving container when in an adjacent pouring position, i.e. under normal pouring conditions as understood by one skilled in the art having the benefit of this disclosure. The serving container may include a first magnet positioned on a distal portion of the serving container and an outer peripheral sidewall, for instance enclosing the first magnet. The receiving container may include a second magnet positioned on a distal portion of the receiving container and an outer peripheral sidewall, for instance enclosing the second magnet.

In particular examples, the receiving container includes a magnetic rim positioned around the periphery of the receiving container. The first magnetic field and the second magnetic field may include a ceramic, a ferrite, a sintered composite of powdered iron oxide and carbonate ceramic magnet, or the like.

In certain examples, the second magnetic field includes an electromagnet. Similarly, the first magnetic field may be an electromagnet. The liquid serving may be a pitcher. The pitcher may have a pouring spout that generally houses the first magnetic field. Further, the assembly may include a plurality of liquid receiving containers, for instance two or more of any of the liquid receiving containers shown and described herein.

Yet another embodiment of the disclosure includes a method for preventing cross-contamination of liquid food service containers. The method may include configuring a liquid serving container with a serving container magnetic area, the serving container magnetic area located in the part of the serving container susceptible to touching a liquid receiving container; and configuring the liquid receiving container with a receiving container magnetic area, the receiving container magnetic area located in the part of the receiving container susceptible to contact with the liquid serving container, the magnetic area of the liquid receiving container being of repelling pole to the magnetic area of the liquid serving container. Typically, the magnetic field of the liquid serving container and the magnetic field of the liquid receiving container repel one another.

The above summary was intended to summarize certain embodiments of the present disclosure. Embodiments will be set forth in more detail in the figures and description of embodiments below. It will be apparent, however, that the description of embodiments is not intended to limit the present inventions, the scope of which should be properly determined by the appended claims.

BRIEF DESCRIPTION OF THE DRAWINGS

Embodiments of the disclosure will be better understood by a reading of the Description of Embodiments along with a review of the drawings, in which.

DESCRIPTION OF EMBODIMENTS

Figure 1A:
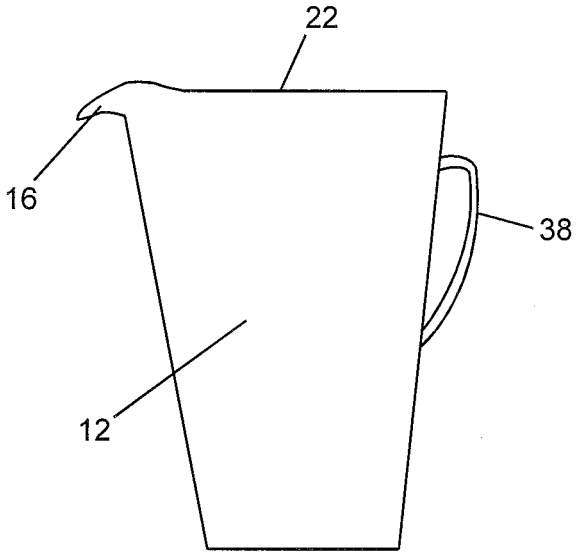
FIG. 1*a* is a front perspective view of a liquid service container according to one embodiment of the disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

Figure 1B:
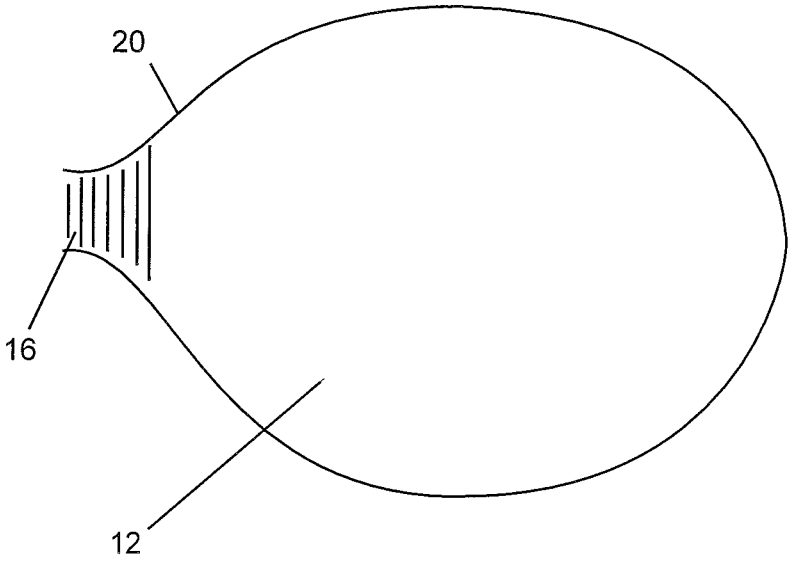
FIG. 1*b* is a top perspective view of the liquid service pitcher introduced in FIG. 1*a;*
Figure 2A:
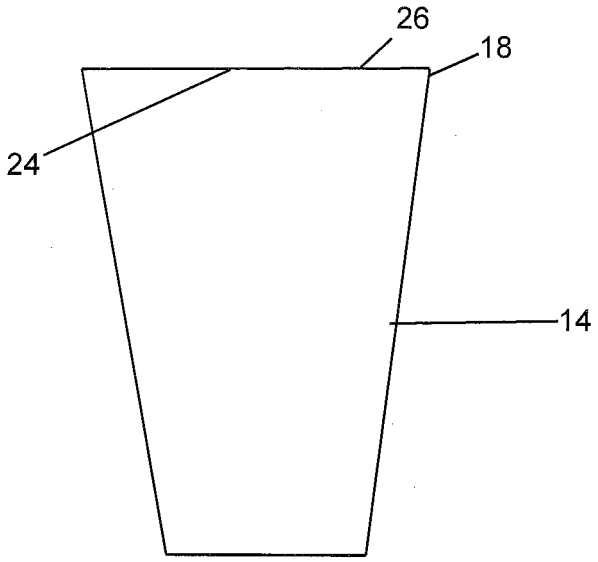
FIG. 2*a* is a front perspective view of a liquid receiving container according to one embodiment of the disclosure.
Figure 2B:
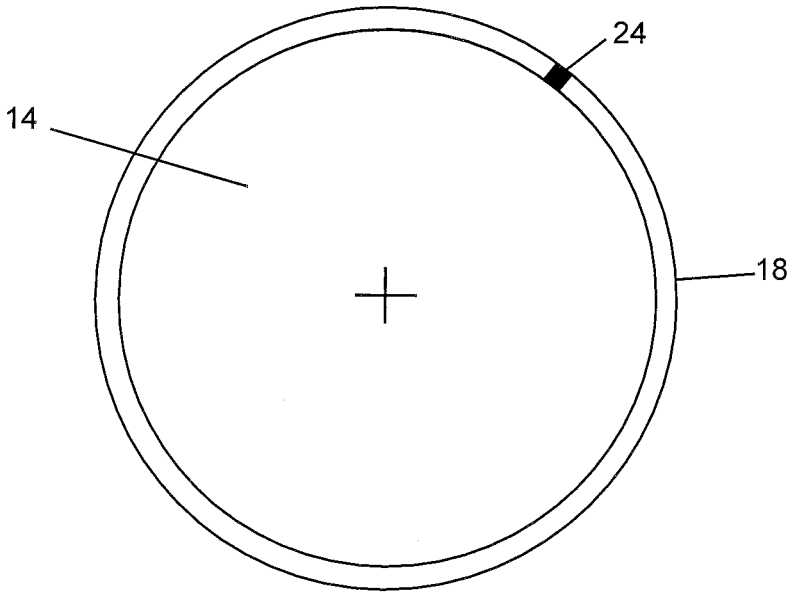
FIG. 2*b* is a top perspective view of the liquid receiving container introduced in FIG. 2*a*.

Referring now to the drawings in general and FIGS. 1 and 2 in particular, it will be understood that the illustrations are for the purpose of describing embodiments of the disclosure and are not intended to limit the disclosure or any inventions thereto. As best seen in FIGS. 1*a,b* and 2*a,b*, liquid serving containers 12 and liquid receiving container 14 are respectively shown embodied according to the present disclosure. As shown in FIGS. 1*a* and 1*b*, a liquid serving container 12 includes an outlet lip 22 having a first magnetic field, for instance as created by magnet(s) 16. The liquid serving container 12 may include any shape, style, and arrangement, including a handle 38 as understood by those skilled in the art having the benefit of this disclosure. As shown in FIGS. 2*a* and 2*b*, a liquid receiving container 14 includes a receiving lip 18 having a second opposing magnetic field, again as created by magnet(s) 24 as shown and described herein. The first magnetic field has second magnetic field to repel one another to prevent cross-contamination, for instance when aligned in an adjacent pouring position as shown and described herein.

In certain examples, combinations of containers with repellent features are provided to prevent one from contacting the opposing container. One method for providing a repellent feature is through the use of magnets. For example, a magnet placed within a pitcher can be repelled by repelling pole magnet within a glass. Such magnetic repulsion can be strong enough to repel the containers but not too strong as to cause other problems. For example, the magnetic field created can be just strong enough to provide the server with a small repellant force; just enough to prevent the touching of the containers but not enough to either overturn the glass or cup.

Embodiments help prevent the spread of bacteria, viruses and the like via cross contamination between drinking glasses using a repelling magnetic force in both the rim of the drinking glass and the spout of the pouring pitcher. In some embodiments the magnets used can be dishwasher safe. Embodiments can be durable enough to maintain the magnetic properties in temperatures ranging from freezer temperatures to above about 200 degrees Fahrenheit.

In embodiments focused on a pitcher, glass or cup combination, the force of the magnet field will be strong enough to repel the partial weight of the water filled pitcher, assuming most of the weight will be bared by the person holding the pitcher.

Embodiments utilize the features of magnets that allow either the creation of a barrier just strong enough to either totally prevent any touching between the pitcher and cup or just enough to provide the server notice that the pitcher is getting too close to the glass.

Magnets can also be used in food service environments to prevent food containers from overturning. For example, on airplanes magnetized containers can be used to prevent spillage. Similarly, glasses and cups can be prevented from overturning on tabletops by using magnets.

In some embodiments electromagnets are used to provide the option to turn the magnetic field on and off. For example, a tray containing glasses or other food or liquid containers, can utilize magnetic attraction to retain the containers on the surface and prevent spillage and breakage. When the containers are to be removed from the tray, the electricity can be turned off to eliminate the magnetic attraction.

In some embodiments both magnetic repulsion and attraction can be used together. For example, a tray and glass combination can utilize magnetic attraction to prevent glasses from falling off the tray or spilling the contents. The same glasses can be attracted to a table surface through magnetic attraction. A pitcher used to add liquid, such as water, to the glass can include repelling pole magnet to provide repulsion to prevent touching of the pitcher to the glass. At the same time, to prevent the repulsion of the pitcher/glass combination from toppling the glass, the glass can be held to the table surface by a magnetic attraction. In some embodiments and combinations an electromagnet is used, for example to remove the glass from a tray or table, or lift the glass to drink, the electromagnet can be turned off.

Embodiments can also be useful to prevent young children from spilling drinks and the like.

Embodiments include relatively weak magnetized place setting adapted to allow food and drink utensils and containers to be attracted and held in place to prevent them from falling of a table or other surface.

Alternative embodiments include liquid, or the like, handling laboratory equipment having opposing magnetic fields as generally shown and described herein. For instance, in certain examples a pipette, tube, or the like as understood by those skilled in the art having the benefit of this disclosure, may have a first magnetic field, for instance as created by any of the magnet(s) arrangements herein. Similarly, a receiving body, for instance a tube, dish, or the like may include a second opposing magnetic field, again as created by magnet(s) arrangements herein. Typically, the first magnetic field has repelling pole of the second magnetic field to repel one another to minimize, or eliminate, contact, unintended touching, and prevent cross-contamination when conducting laboratory analysis and/or diagnostic tests. The magnets may be positioned on outer lips, surfaces, and the like of the first and second laboratory devices to avoid contact and minimize magnetic exposure to samples, reagents, and similar laboratory elements.

In other embodiments, the disclosure includes assemblies, kits, and/or materials for assemblage for preventing cross-contamination. In this embodiment, the assembly may comprise a liquid serving containers 12, e.g. any of the serving containers elements and examples previously shown or described. The assembly may also comprise a receiving container 14, e.g. any of the receiving container elements and examples previously shown or described.

Numerous characteristics and advantages have been set forth in the foregoing description, together with details of structure and function. Many of the novel features are pointed out in the appended claims. The disclosure, however, is illustrative only, and changes may be made in detail, especially in matters of shape, size, and arrangement of parts, within the principle of the disclosure, to the full extent indicated by the broad general meaning of the teens in which the general claims are expressed. It is further noted that, as used in this application, the singular forms "a," "an," and "the" include plural referents unless expressly and unequivocally limited to one referent.

I claim:

1. An assembly for preventing cross-contamination of liquid food service containers, the assembly comprising;

a. a liquid serving container including an outlet lip having a first magnetic field; and b. "at least one liquid receiving container including a receiving lip having a second magnetic field adapted to repel the first magnetic field, and wherein the serving container's outlet lip being adapted to be susceptible to contact with the receiving container's receiving lip, and whereby the first magnetic field of the serving container and the second magnetic field of the receiving container repel one another to prevent cross-contamination".

2. The assembly of claim 1, wherein the first magnetic field and the second magnetic field each comprise a magnetic strength sufficient to prevent contact between the serving container and the receiving container when in an adjacent pouring position.

3. The assembly of claim 1, wherein the serving container comprising a first magnet positioned on a proximate portion of the serving container and an outer peripheral sidewall enclosing the first magnet.

4. The assembly of claim 1, wherein the receiving container comprising a magnetic rim positioned around the periphery of the receiving container.

5. The assembly of claim 1, wherein the first magnetic field and the second magnetic field being created by a magnet chosen from the group consisting of ceramic, a ferrite, a sintered composite of powdered iron oxide, and carbonate ceramic.

6. The assembly of claim 1, wherein the second magnetic field comprising an electromagnet.

7. The assembly of claim 1, wherein the first magnetic field comprising an electromagnet.

8. The assembly of claim 1, "wherein the liquid serving container is a pitcher".

9. The assembly of claim 8, wherein the pitcher comprising a pouring spout housing the first magnetic field being positioned on a bottom portion of pouring spout out of contact with contents within the pitcher.

10. The assembly of claim 1, further including a plurality of liquid receiving containers.

11. "A device to prevent cross-contamination of liquid food service containers comprising: a liquid serving container, the container including a magnetic portion, the magnetic portion providing a magnetic field in an area susceptible to touching a liquid receiving container, the liquid receiving container including a second opposing magnetic portion in the area susceptible to contact with the liquid serving container, the magnetic portion of the liquid receiving container being adapted to repel the magnetic portion of the liquid serving container, and wherein the magnetic field of the liquid serving container and the magnetic field of the liquid receiving container repel one another".

12. The device of claim 11, wherein the liquid serving container's magnetic portion comprising an electromagnet.

13. The device of claim 11, wherein the liquid receiving container's magnetic portion comprising an electromagnet.

14. The device of claim 11, "wherein the liquid serving container is a pitcher".

15. The device of claim 14, wherein the pitcher comprising a pouring spout housing the magnetic portion.

16. "A method for preventing cross-contamination of liquid food service containers comprising: configuring a liquid serving container with a serving container magnetic area, the serving container magnetic area located in the part of the serving container susceptible to touching a liquid receiving container; and configuring the liquid receiving container with a receiving container magnetic area, the receiving container magnetic area located in the part of the receiving container susceptible to contact with the liquid serving container, the magnetic area of the liquid receiving container adapted to repel the magnetic area of the liquid serving container, and wherein the magnetic field of the liquid serving container and the magnetic field of the liquid receiving container repel one another".

* * * * *